United States Patent [19]

Harris

[11] 3,947,790

[45] Mar. 30, 1976

[54] AUTOMATIC RESET TIMER

[75] Inventor: John L. Harris, Clearwater, Fla.

[73] Assignee: Deltrol Corporation, Bellwood, Ill.

[22] Filed: Sept. 13, 1974

[21] Appl. No.: 505,547

[52] U.S. Cl. ..... 335/75; 200/38 R

[51] Int. Cl.[2] ..... H01H 43/00

[58] Field of Search ..... 335/63, 65, 68, 71, 73, 335/74, 75; 200/38 R

[56] References Cited

UNITED STATES PATENTS

| | | | |
|---|---|---|---|
| 3,713,053 | 1/1973 | Mahon | 335/75 |
| 3,774,127 | 11/1973 | Ohashi | 335/74 X |

*Primary Examiner*—G. Harris

[57] ABSTRACT

An automatic reset timer having a motor and a separate solenoid operated clutch. The solenoid also actuates a switch to timing position, through a first latch, the switch being held there by a second latch. Both latches are released by the timing mechanism. The double latch allows the switch to remain in timing position regardless of the solenoid position. A solenoid lever is mounted behind a mechanism plate and carries mode selectors for setting the type of control of the switch and clutch by the solenoid. These mode selectors are accessible through openings in the plate normally covered by the timer motor.

19 Claims, 16 Drawing Figures

ON DELAY SOLENOID OUT

TIMED OUT

OFF DELAY SOLENOID OUT

ON DELAY SOLENOID IN

LATCHED IN TIMING

OFF DELAY SOLENOID IN

"B" SELECTOR - SOLENOID IN TIMED OUT

"B" SELECTOR-SOLENOID OUT TIMING

"M" SELECTOR- SOLENOID OUT TIMED OUT

"M" SELECTOR - SOLENOID IN TIMING

AUTOMATIC RESET TIMER

BACKGROUND OF THE INVENTION

This invention relates to electro-mechanical timing devices and more particularly to timers of the automatic reset type.

In many timing applications it is necessary to start and control the timer from a remote point and also have the time cycle adjustable. This has led to use of motor driven automatic reset timers in which a spring return timing mechanism resets to an adjustable starting position when a clutch is released. To start a timing cycle, the clutch is engaged and the mechanism drives to a "timed out" position in which one or more switches transfer from "timing" position to "timed out" position.

In some applications it is required to delay operation of the timer switch until the end of the time cycle. This is known as delay timing. In this case the timer switch is returned from timed-out to timing position prior to the start of the cycle so that no timer switch operation takes place at the start of the cycle.

In other applications it is necessary to energize a load at the start of the cycle and to deenergize it at the end of the cycle. This is known as interval timing. This type of operation requires more mechanism than simple delay timing, either built into the timer or a relay external to the timer.

In certain applications it is required or permissable for the timer to reset to starting position in response to a power interruption. Here the timer clutch is released in response to deenergization of an electromagnet. This is known as "on delay".

In other cases it is necessary for the timer to hold its position in case of power failure. In others it is required to reset in response to making of the control circuit. The timer clutch disengages in response to energization of the electromagnet. This is known as "off delay".

The different requirements met in the field in addition to the basic requirements of "on delay", "off delay", and "interval" are many. In some, the cycle start must be from closure of the control circuit, in others from control circuit opening. In some the control circuit action is only momentary. In others it is sustained. These various requirements have required numerous models of timers and in addition considerable outside circuitry to get the results needed.

In order to reduce models required and also reduce outside circuitry it has been common to build timers with two "delay" switches actuated by the timer and two "instantaneous" switches actuated by the electromagnet. These switches have individual terminals allowing the user to connect them in various manners to obtain different results from the timer. This is expensive. The customer must buy more than he needs. He must spend considerable time cross-wiring the switches. In addition, often half of the switches are used up cycling the timer so that they are not available for controlling external loads.

My copending application Ser. No. 333,767 filed Feb. 20, 1973, shows an automatic reset timer with multiple switches and with separate mode selectors for the switches and clutch at the back of the timer. This makes a single model of timer easily converted to give the results needed for the application and simplifies or eliminates external circuitry. This timer is in the expensive and high class field and its cost precludes its use in many applications not requiring this degree of quality.

BRIEF SUMMARY OF THE INVENTION

The primary object of the invention is the provision of a simple low cost automatic reset timer in which a single timer assembly can be adjusted without disassembly to give a variety of different responses to an external control circuit.

In accordance with the invention, a main mechanism plate houses a timer mechanism and solenoid, and also supports an external timer motor. The solenoid actuates the timer switch and clutch in independent manners through a lever which bodily carries switch and clutch mode selectors. These selectors are adjustable from outside the timer through openings in the plate.

Another object of the invention is the provision of a timer in which a solenoid drives the switch to timing positions and in which the switch stays in this position independently of the solenoid. In accordance with the invention, the solenoid drives the switch to timing position through a driving latch and the switch is then held in timing position by a holding latch. The timing mechanism releases both latches simultaneously.

DETAILED DESCRIPTION OF THE INVENTION

Figure 3:
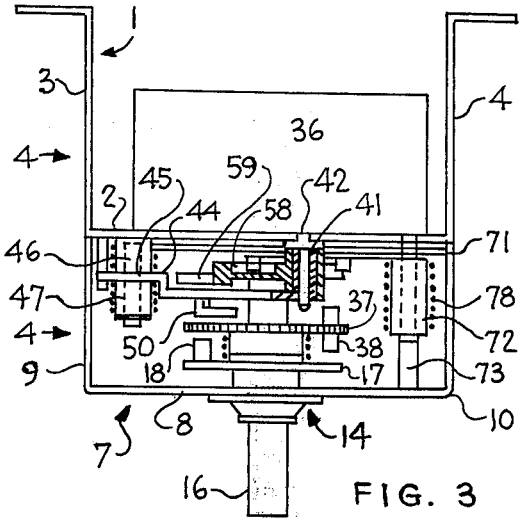
FIG. 3 is a top view of FIG. 1 with the switch removed and the top cover broken away.
Figure 2:
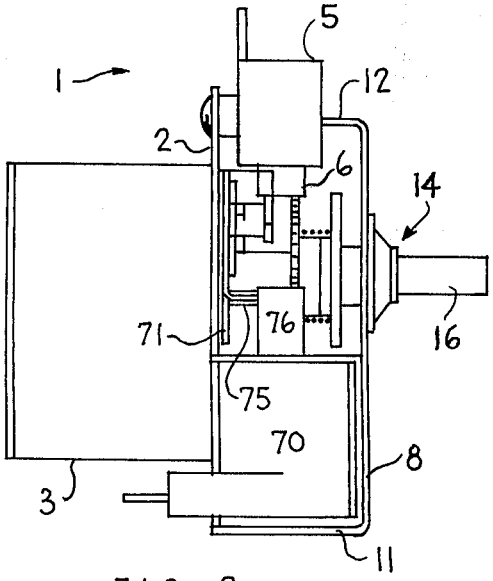
FIG. 2 is a side view of FIG. 1 with the front cover broken away.
Figure 1:
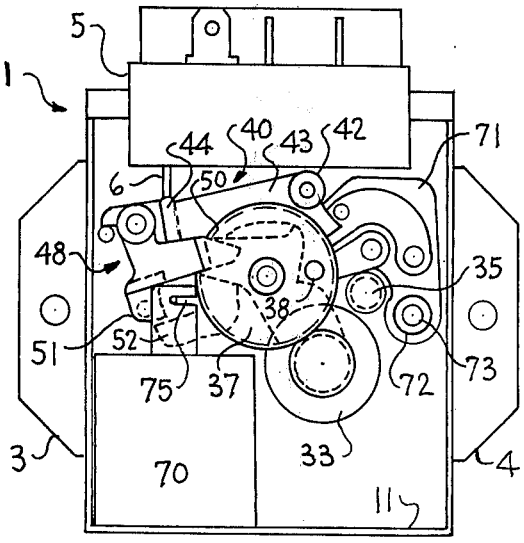
FIG. 1 is a front view of a timer embodying the invention with the front cover removed to show the mechanism.

Referring to FIGS. 1, 2 and 3 reference character 1 indicates generally a mounting base or bracket having a timer base portion 2 and rearwardly extending mounting legs 3 and 4. This supports a plunger operated enclosed switch 5 having an operating plunger 6. The base 1 also supports a front housing member and mechanism base generally indicated as 7, this housing member including a front wall 8, side walls 9 and 10, a bottom wall 11 and a top wall 12 which is notched to fit over the switch 5.

This front wall 8 supports a setting shaft assembly 14 (FIG. 5) including a sleeve 15 which is press fit over a shaft 16 and rigidly supports a setting plate 17 carrying a stop pin 18. The friction hub 15 is formed with a shoulder bearing against the front plate 8, a reduced diameter portion extending through the plate and receiving a tension washer 19 and a press-on type retainer 20. It will be apparent that rotation of the adjusting shaft 16 sets the angular position of the stop pin 18.

A stud 22 is secured in the rear enclosure plate 2 and extends forwardly into an opening in the rear of shaft 16. Preferrably the stud 22 includes a clutch bearing portion 23 which receives the hub 24 of the clutch operator generally indicated as 25. The outline of this clutch operating means 25 is more clearly shown in FIG. 12 and is a lever having a bearing on pivot 23 and a clutch gear supporting arm 26. It also includes oppositely acting operating surfaces 27 and 28 located at opposite sides of pivot 23. It also includes a third operating surface 29 which is engaged by the switch operator as will be later described.

Figure 12:
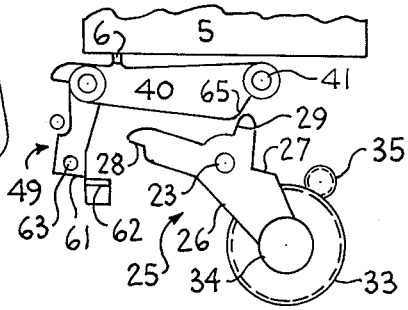
FIG. 12 is a fragmentary view showing the switch operator held in timing position by the holding latch, with the clutch engaged.

The clutch gear supporting arm 26 terminates in a hub 31 (FIG. 5) which receives a shaft 32 which carries clutch gear 33 and pinion 34. As shown in FIG. 12, the gear 33 when the clutch is engaged meshes with the pinion 35 of the timer motor 36 (FIG. 3). The pinion 34 which is driven by gear 33 meshes with timing gear 37 having a pin 38 extending both forwardly and rearwardly. This timing gear is held in place on shaft 16 by a suitable retainer and is formed with a hub receiving a reset spring 39. When the clutch operator 25 is in the position shown in FIG. 12, gear 33 meshes with the motor pinion 35, this driving the timing gear 37 in a counterclockwise direction as seen in FIG. 1 against the action of the reset spring 39. When the clutch operator 25 is rotated slightly clockwise as shown in FIG. 1, the gear 33 disengages from the motor pinion 35, this allowing the reset spring 39 to rotate the timing gear clockwise until pin 38 engages stop pin 18 on the setting plate 17. Thus when the clutch is disengaged the timer resets to its starting point.

Figure 4:
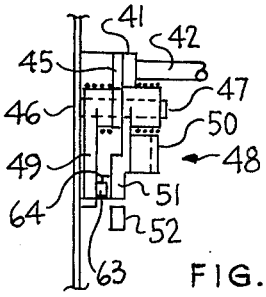
FIG. 4 is a side view taken on line 4—4 of FIG. 3 with the side of the cover removed.

The plunger 6 of the enclosed switch 5 is actuated by a switch operator generally indicated as 40. This switch operator as shown in FIGS. 1 and 3 includes a hub 41 fitting over a pin 42, this hub supporting an arm 43 which extends to the left to an offset portion 44 which engages the switch plunger 6. This offset portion 44 merges with a latch supporting portion 45 carrying latch studs 46 and 47. Latch stud 47 extends forwardly as shown in FIG. 4 and pivotally supports a lifting latch 48 while stud 46 extends rearwardly and supports a holding latch 49. The lifting latch 48 includes an operating portion 50 which extends inwardly under the timing gear 37 and is actuated by pin 38 at the end of the time cycle. The latch 48 also includes a downwardly extending latching portion 51 which is arranged to be engaged by the end 52 of a lifting lever or driven actuator means generally indicated as 53. This lifting lever is more clearly shown in FIG. 16 in which the other parts have been broken away to more clearly show it. It includes a hub 55 which fits over the hub 41 of the switch operator in a manner permitting free relative motion between these two parts. This lifting lever also includes an operating surface 56 which is to the right of pivot pin 41 and an operating surface 57 which is the top of a recess 58 formed in the back of the lever (see FIG. 3). Lever 53 also includes a downwardly depending portion 59 which leads to the lifting surface 52.

Figure 13:
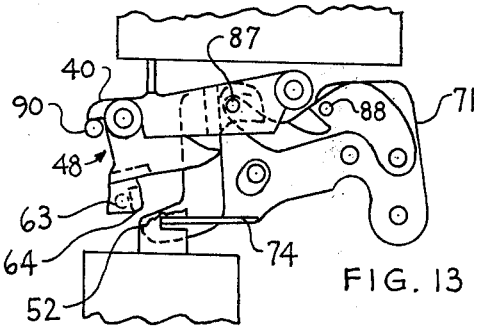
FIGS. 13 and 14 are fragmentary views showing the solenoid and switch operation when the switch mode selector is set for shifting the switch to timing position on a break in the solenoid circuit.

The outline of the holding latch 49 is more clearly shown in FIG. 12. This latch extends downwardly from its bearing and has a latching surface 61 which engages a tab 62 struck out from the back plate 2. This latch also includes a forward extension 63 which is engaged by a rearwardly extending tab 64 on the lifting latch 48 (FIG. 13). The tab 64 and pin 63 are located relative to each other in a manner to cause the latching surface 62 of latch 49 to release from tab 62 at the same time that latch 48 releases from the end 52 of the lifting lever.

Figure 11:
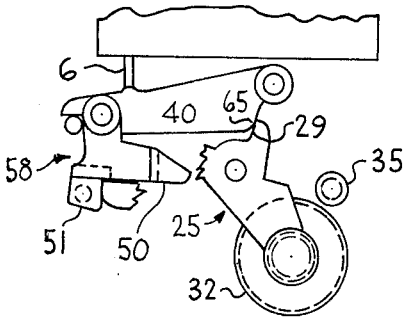
FIG. 11 is a fragmentary view showing the switch operator in timed-out position which releases the clutch.

From the description thusfar, it will be apparent that a downward force applied to operating surface 56 or an upward force applied to operating surface 57 of the drive lever 53 will cause this lever to rotate clockwise. This will bring the latching end 52 of the drive lever into engagement with the lower end 51 of lifting latch 48. After parts 51 and 52 engage, lever 53 and switch operator 40 rotate in unison about pivot 42, this causing upward movement of the switch plunger 6. Then the switch operator 40 is lifted to the point where the holding latch 49 clears the stationary tab 62, latch 49 will drop in place and hold the switch operator in its raised position independently of the drive means consisting of the drive lever 53 and lifting latch 48. This position in which the switch operator is raised and held in raised position, is the timing position for the timer. At this time, surface 65 on the switch operator has disengaged the abutting surface 29 on the clutch operator 25 as shown in FIG. 12. This allows the clutch operator to rotate counterclockwise until gear 33 meshes with the motor pinion 35. If the timer motor is now energized, it will drive the timing gear 37 counterclockwise as seen in FIG. 1. As the end of the time cycle approaches, the pin 38 on the timing gear engages the operating end 50 of the lifting latch 48 and starts moving it counterclockwise toward releasing position. Also the tab 64 at the back of latch 48 engages pin 63 on the holding latch 49 (FIG. 13) and moves this latch toward releasing position. At the end of the timing cycle, both latches release simultaneously and the switch operator 50 drops back to timed-out position as shown in FIGS. 1 and 11. Here operating surface 65 on the switch operator 40 has engaged the operating surface 29 on clutch operator 25 and caused gear 33 to disengage the motor pinion 35. The clutch is thus disengaged and the reset spring 39 for the timing gear 37 rotates this gear clockwise back to the starting point where pin 38 engages stop pin 18. Summarizing, the parts are moved into timing position by applying power to the drive lever 53, this power being applied to the switch operator through latch 48. Once the parts are in timing position they are held there by the holding latch and no further application of force to the drive lever 53 is required. When the parts reach timing position, the clutch is engaged and the timer drives to the timed-out position where both latches are released. Release of the driving latch 48 in effect disables the drive means for the switch operator and the switch operator can return back to timed-out position regardless of the position of the power lever 53.

Referring to FIG. 12, it will be apparent that the clutch may also be released by applying either a downward force to the operating surface 27 of the clutch operating lever or an upward force to the operating surface 28 of this same lever. The clutch lever 25 and switch power lever 53 are actuated by the solenoid 70 through an adjustable selective drive means which will now be described.

Figure 5:
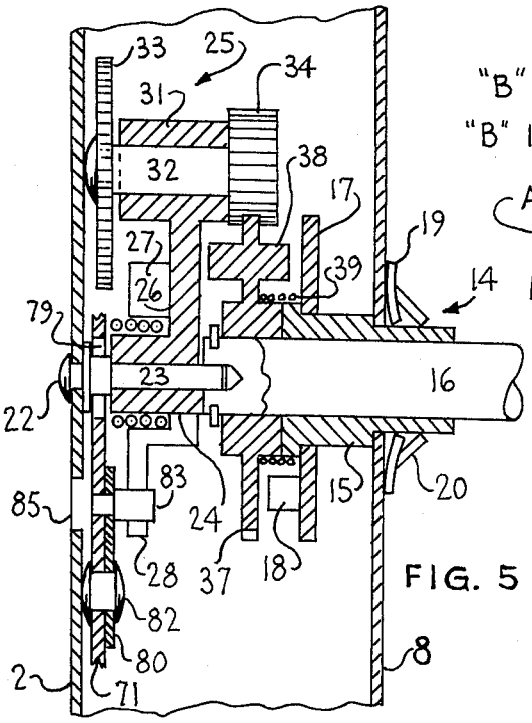
FIG. 5 is an enlarged sectional view of the main shaft assembly and clutch operating mechanism; p

A solenoid lever or driving actuating means 71 is attached to a hub 72 fitting over a shaft or pivot 73 preferrably attached to the front plate 8 and extending into the back plate 2. This lever is generally flat and extends closely adjacent the back plate 2 as shown in FIGS. 3 and 5. This plate extends across the back of the housing and includes an out-turned portion 75 which extends into a notch in the solenoid plunger 76. This solenoid lever 71 is biased in a clockwise direction by a torsion type spring 78 carried by hub 72. It will be apparent that when the solenoid 70 is deenergized as shown in FIG. 1 the spring will rotate the lever to its counterclockwise limit of rotation which is determined by bottom of hold 79 in the solenoid lever engaging the pin 22 which passes through this hold as shown in FIG. 5. When the solenoid is energized, the plunger 76 will move downwardly as shown in FIG. 1 and act through ear 75 to rotate lever 71 counterclockwise against the action of its biasing spring.

Figure 6:
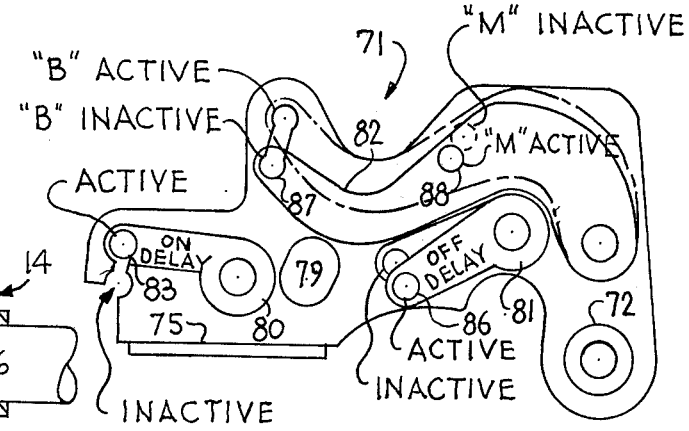
FIG. 6 is an enlarged view of the solenoid lever and mode selector assembly.

As shown in FIG. 6, the solenoid lever carries a clutch on-delay mode selector 80, a clutch off-delay mode selector 81 and a switch mode selector 82. The mode selector 80 is of spring material and lies in front of the solenoid lever, being attached thereto by a rivet 82 which is set so as to permit rotation of the mode selector 80 relative to solenoid lever 71. This mode selector carries an operating abutment means 83 which is preferrably a pin having a shoulder and a reduced portion which is upset behind the mode selector. This pin extends into a double recess having an active upper circular opening and a lower inactive opening. The back end of abutment or selective engaging means 83 is accessable from outside of the timer case through an opening 85 which is normally covered by the timer motor 36. It may be adjusted from its active position to its inactive position and vice versa by applying a pointed tool into the back of the stud and pushing it forwardly to release the end from the recess in the solenoid lever. After the end of pin 83 clears the lever, it is free to rotate and may be rotated to its other position where it snaps into place. This arrangement thus provides spring means for allowing movement of the mode selector and detent means for retaining the selector in its adjusted position. The off-delay mode selector 81 may be identical with the on-delay selector 80 and includes a pin 86 which may be set at either active or inactive position.

Figure 16:
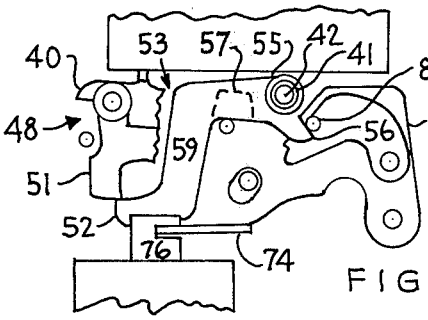

The switch mode selector 82 includes a stud 87 which is identical with stud 83 and fits into active and inactive recesses formed in the plate. This mode selector 82 also includes a stud 88 which extends forwardly in identical manner to the other studs. As shown in FIG. 16 the stud 88 is in position to co-act with the operating surface 56 of the power lever 53. It will be apparent that when this stud is in its active position as shown, making of the solenoid circuit will energize same causing the plunger 76 to move down and rock the solenoid lever counterclockwise. Stud 88 will now engage the operating surface 56 of the power lever 53 which causes this lever to rotate clockwise and raise the switch operator to timing position. Stud 88 when active thus causes the timer to shift to timing on make of a circuit and is thus referred to as "M." When the stud 88 is in its active position, which is down as seen in FIG. 6, the stud 87 is in its bottom detent which is its inactive position. The stud 87 when active, is in its upper position and held there by its holding detent. In this position, when the solenoid drops out, it engages the lifting surface 57 for the power lever 53 and it moves the mechanism to timing position. Stud 87 thus, when active, causes the timer to shift to timing on a break in the solenoid circuit and is thus referred to as "B."

Figure 7:
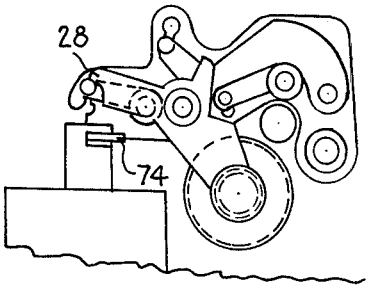
FIGS. 7 and 8 are fragmentary views showing the clutch and solenoid operation when the clutch mode selectors are set for "on-delay"
Figure 8:
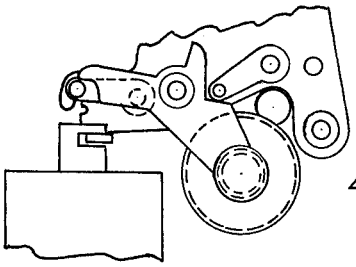

When an on-delay clutch is desired the on-delay mode selector 80 is set to its active position and the off-delay selector 81 is set to its inactive position. This arrangement is shown in FIGS. 7 and 8. When the solenoid is out as shown in FIG. 7, the on-delay actuator engages the left hand operating surface 28 of the clutch lever and rotates the lever to clutch disengaged position. When the solenoid is energized the on-delay selector drops permitting counterclockwise rotation of the clutch lever engaging the clutch. As the off-delay selector is in its inactive position it is up and out of the way and does not interfere with engagement of the clutch.

Figure 9:
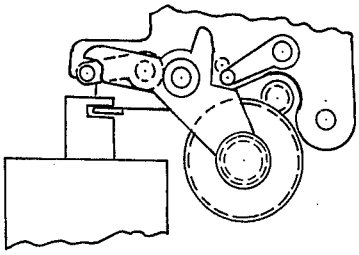
FIGS. 9 and 10 are similar views showing the clutch and solenoid operation when the clutch mode selectors are set for "off-delay"
Figure 10:
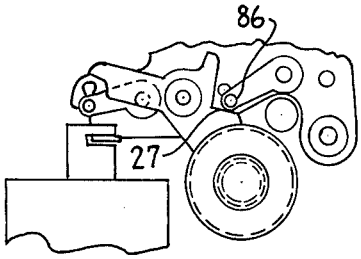

In off-delay clutch operation it is desired, the on-delay abutment 83 is moved down to its inactive position and the off-delay abutment 86 is moved down to its active position. This setting is shown in FIGS. 9 and 10. When the solenoid is out as shown in FIG. 9, neither abutment engages the solenoid lever and the clutch is engaged as shown. However, when the solenoid is energized, the off-delay abutment 86 engages operating surface 27 of the solenoid lever 25 rotating this lever clockwise to disengage the clutch.

If solenoid operation of the clutch is not desired, both clutch mode selectors are placed in their inactive positions. When in these positions neither abutment 83 or 86 will engage the clutch lever regardless of the position of either the solenoid lever or clutch lever. It will be noted from FIG. 11 that the clutch is disengaged by the timing mechanism at the timed-out position. Hence it is unnecessary for the solenoid to have any effect on the clutch in order for the timer to go through its cycle.

Figure 14:
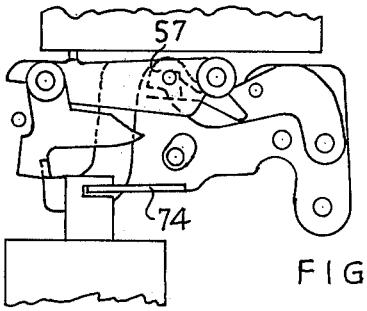

Referring now to the switch mode selector, FIGS. 13 and 14 show the action occuring when the selector is set for B active. This setting of the switch mode selector automatically makes the B stud 87 active and the M stud 88 inactive. This setting of the mode selector is used when it is desired for the timer to transfer from the timed-out to timed position on a break in the solenoid control circuit. This setting would be used for an on-delay timer or for an interval timer in which the cycle is to start on a break in the control circuit. FIG. 13 shows the position of the switch operator in the timed-out position with the solenoid energized. As the M stud 88 is in its inactive position it has not interferred with the counterclockwise rotation of drive lever 53 to its down position. Also the B stud 87 is in its down position due to the solenoid being energized. The switch operator 40 is thus down allowing the switch to be in its timed-out position. At this time the end of the switch operator 40 is engaging the stationary stud 90 which limits its downward travel and a space exists between the end of lifting latch 48 and the lifting surface 52 of drive lever 53. The switch operator 40 is thus in its timed-out position and the clutch is disengaged as shown in FIG. 11.

When the solenoid is deenergized, its biasing spring rotates the solenoid lever 71 clockwise and the B stud 87 engages the lifting surface 57 of drive lever 53 rotating it clockwise about its pivot. This first takes up the space between the surface 52 and the end of the latch. Thereafter rotation of the drive lever causes corresponding rotation clockwise of the switch operator 40 to the timing position shown in FIG. 14. At this time the operator 40 is also held in its timing position by the holding latch 49 (FIG. 12). Also the switch operator has released the clutch lever 25 allowing the clutch to engage. As the holding latch is now holding the switch operator in timing position independently of the lifting latch 48 it is now immaterial whether the solenoid is in or out in order for the switch operator to remain in timing position. All that is necessary now in order to complete a timing cycle is for the solenoid to be in position for allowing clutch engagement and for the timer motor to be energized. When these conditions are met, the timer runs through its cycle and simultaneously releases both the holding latch and the lifting latch permitting the parts to move back to the timed-out position as shown in FIG. 11. In order to start a new cycle, the solenoid must be in its energized position after completion of the time cycle as shown in FIG. 13 in order for the lifting latch 48 to return to latching position.

From the foregoing it will be apparent that setting of the B switch mode selector 87 to its active position, will cause the timer to shift from its timed-out position to timing position when the control circuit to the solenoid is broken. When other conditions are met causing the timer motor to run and the clutch to engage, the timer will run through its cycle and return to the timed-out position.

Figure 15:
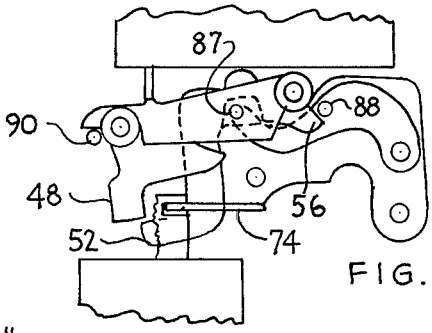
FIGS. 15 and 16 are similar views showing the solenoid and switch operation when the switch mode selector is set for shifting the switch to timing on a make of the solenoid circuit.

FIGS. 15 and 16 show the action occuring when the switch M mode selector 88 is set to its active position. At this time the B abutment 87 is in its inactive position. FIG. 15 shows the positions of the parts when the solenoid is out and the timer is in its timed-out position. At this time the switch operator 40 is down and its motion is limited by the stud 90. The end of lifting latch 48 is in the path of the end 52 of the drive lever. The M stud 88 is adjacent the operating surface 56 of the drive lever and the inactive B stud 87 has not interferred with the downward travel of the drive lever. When the solenoid is energized, it rotates the lever 71 counterclockwise and the M abutment 88 engages surface 56 of the drive lever causing it to rotate clockwise about its pivot. This acts through the latch 48 to lift the switch operator 40 to its timing position where it is now held by the holding latch 49. As the switch operator is now held in timing position by the holding latch it is immaterial whether the solenoid is energized or deenergized in order for the timer to remain in timing position. As shown in FIG. 12, the clutch is permitted to engage by the switch operator. All that is necessary now in order to complete a timing cycle is for the motor to be energized and for the solenoid to be in position for the clutch to engage. When these conditions are met the timer runs through its time cycle and releases the holding and lifting latches and the switch operator returns to its timed-out position as shown in FIG. 11 where the clutch is disengaged by the switch operator independently of the solenoid position.

In some applications it may be desirable for the switch position to be dependent on the solenoid position during the time cycle. For example in an interval timing application it may be desirable for the switch to return from timing to timed-out in the event the solenoid is deenergized during the cycle. In such applications the holding latch 49 may be omitted so that the switch operator position is dependent upon the solenoid.

From the foregoing it will be apparent that the invention provides a low cost automatic reset timer in which the response in clutch operation and in transferring of the switch from timed-out to timing are independently adjustable. It will be further apparent that these adjustments can be made without disassembling the timer through openings in the back plate of the timer which are normally covered by the timer motor. It will be further apparent that setting of the mode selectors for the clutch and switch operation provide for many different responses or "models" of timers. Setting of the mode selectors for the particular application simplifies control circuitry and also simplifies stocking problems for dealers. One basic model replaces a wide variety of standard and special models heretofore required. While a preferred form of the invention has been showed and described it is obvious that many modifications may be made without departing from the spirit and scope of the invention as defined in the following claims.

I claim:

1. In an automatic reset timer having a timer motor and mechanism components including a spring return timing element and drive means including a clutch whereby the timing element is driven in one direction when the clutch is engaged and returns to a starting point when the clutch is disengaged, a clutch operating lever for controlling the clutch, said clutch lever having a pivot, a first operating surface on one side of the pivot and a second operating surface on the other side of the pivot, an electromagnet, an operator actuated by the electromagnet and adjacent to the clutch operating lever, means including an enclosure plate for at least partially enclosing the mechanism components, the clutch lever and the operator, said operator being mounted near said plate on one side thereof, and first and second abutment means bodily carried by the operator and arranged to cooperate with the first and second operating surfaces respectively of the clutch lever to cause movement thereof in response to movement of the electromagnet, each abutment means being adjustable on the operator between an active position where it is operable to cause movement of the clutch lever and an inactive position where it has no effect on the clutch lever, and means accessible from the other side of the plate for adjusting the positions of said abutment means.

2. In an automatic reset timer having a timer motor and mechanism components including a spring return timing element and drive means including a clutch whereby the timing element is driven in one direction when the clutch is engaged and returns to a starting point when the clutch is disengaged, an operator for the clutch having one position in which the clutch is engaged and another position in which the clutch is disengaged, an electromagnet, adjustable motion transmitting means between said electromagnet and said operator arranged to apply power from the electromagnet to the operator and move the operator from one of its positions to its other position, said motion transmitting means including driving actuator means actuated by the electromagnet and driven actuator means causing movement of the operator to its timing position, one of said actuator means including a pivot, and adjustable selective engaging means bodily carried by one actuator means for engaging the other, said selective engaging means being arranged to provide engagement on one side or the other of the pivot and reverse the direction of movement of the operator relative to the electromagnet, said selective engaging means including a member permanently attached to its actuator means and movable between an active position and an inactive position, and means including spring means and detent means associated with said member for holding it in at least one of its positions.

3. In an automatic reset timer having a timer motor and mechanism components including a spring return timing element and drive means including a clutch for driving the timing element in one direction when the clutch is engaged and returning the timing element to a starting point when the clutch is disengaged, a control device, an operator for the control device having a timing position and a timed-out position, an electromagnet, adjustable motion transmitting means between said electromagnet and said operator arranged to apply power from the electromagnet to the operator and move the operator from its timed-out position to its timing position, said motion transmitting means including lever means having a pivot, a first operating surface for the lever means on one side of the pivot and a second operating surface for the lever means on the other side of the pivot, a second operator actuated by the electromagnet and located adjacent the lever means, and first and second abutment means bodily carried by the second operator and arranged to cooperate with the first and second operating surfaces respectively, said abutment means being adjustable from active positions to inactive positions for determining whether the first operator is moved to timing position by energization or deenergization of the electromagnet.

4. The combination recited in claim 3 in which the motion transmitting means between the electromagnet and operator includes latching means, the motion being transmitted through the latching means, and means operated by the timing element for releasing the latching means.

5. The combination recited in claim 3 including latching means for holding the operator in timing position independently of the electromagnet, and means operated by the timing element for releasing the latching means.

6. The combination recited in claim 4 including a second latching means arranged to hold the operator in timing position independently of the electromagnet, and means for releasing the second latching means substantially simultaneously with the first latching means.

7. In an automatic reset timer having a timer motor and mechanism components including a spring return timing element and drive means including a clutch for driving the timing element in one direction when the clutch is engaged and returning the timing element to a starting point when the clutch is disengaged, a control device, an operator for the control device having a timing position and a timed-out position, an electromagnet, adjustable motion transmitting means between said electromagnet and said operator arranged to apply power from the electromagnet to the operator and move the operator from one of its positions to its other position, said motion transmitting means including driving actuator means actuated by the electromagnet and driven actuator means causing movement of the operator to its timing position, one of said actuator means including a pivot, and adjustable selective engaging means bodily carried by one actuator means for engaging the other, said selective engaging means being arranged to provide engagement on one side or the other of the pivot and reverse the direction of movement of the operator relative to the electromagnet, said selective engaging means including a member permanently attached to its actuator means and movable between an active position and an inactive position, and means including spring means and detent means associated with said member for holding it in at least one of its positions.

8. The combination recited in claim 7 in which the motion transmitting means between the electromagnet and operator includes latching means, the motion being transmitted through the latching means, and means operated by the timing element for releasing the latching means.

9. The combination recited in claim 7 including latching means for holding the operator in timing position independently of the electromagnet, and means operated by the timing element for releasing the latching means.

10. The combination recited in claim 8 including a second latching means arranged to hold the operator in timing position independently of the electromagnet, and means for releasing the second latching means substantially simultaneously with the first latching means.

11. In an automatic reset timer having a timer motor and mechanism components including a spring return timing element and drive means including a clutch for driving the timing element in one direction when the clutch is engaged and returning the timing element to a starting point when the clutch is disengaged, a control device, an operator for the control device having a timing position and a timed-out position, an electromagnet, adjustable motion transmitting means between said electromagnet and said operator arranged to apply power from the electromagnet to the operator and move the operator from one of its positions to its other position, said motion transmitting means including driving actuator means actuated by the electromagnet and driven actuator means causing movement of the operator to its timing position, one of said actuator means including a pivot, and adjustable selective engaging means bodily carried by one actuator means for engaging the other, said selective engaging means being arranged to provide engagement on one side or the other of the pivot and reverse the direction of movement of the operator relative to the electromagnet, a clutch operator having one position in which the clutch is engaged and another position in which the clutch is disengaged, adjustable motion transmitting means between the clutch operator and the electromagnet, said last mentioned motion transmitting means including a second driven actuator means driven by said driving actuator means and a second selective engaging means bodily carried by one of said last mentioned actuator means, said second selective engaging means being arranged for reversal of motion of the clutch operator relative to the electromagnet.

12. The combination recited in claim 11 in which the clutch is also released by movement of the first operator to its timed-out position, and in which the second selective engaging means is settable to prevent actuation of the clutch operator by the electromagnet.

13. The combination recited in claim 11 in which the motion transmitting means between the electromagnet and operator includes latching means, the motion being transmitted through the latching means, and means operated by the timing element for releasing the latching means.

14. The combination recited in claim 11 in which the motion transmitting means between the electromagnet and operator includes latching means, the motion being transmitted through the latching means, and means operated by the timing element for releasing the latching means.

15. The combination recited in claim 13 including a second latching means arranged to hold the operator in timing position independently of the electromagnet, and means for releasing the second latching means substantially simultaneously with the first latching means.

16. In an automatic reset timer having a timer motor and mechanism components including a spring return timing element and drive means including a clutch for driving the timing element in one direction when the clutch is engaged and returning the timing element to a starting point when the clutch is disengaged, a control device, an operator for the control device having a timing position and a timed-out position, means biasing said operator toward its timed-out position, an electromagnet, drive means including a latch between said electromagnet and operator whereby motion of the electromagnet causes movement of the operator from its timed-out position to timing position through said latch, and means actuated by said timing element for releasing the latch to cause return of the operator to timed-out position.

17. The combination recited in claim 16 including a second latch arranged to hold the operator in timing position independently of said first latch and drive means, and means actuated by the timing element for releasing both latches substantially simultaneously.

18. In an automatic reset timer having a timer motor and mechanism components including a spring return timing element and drive means including a clutch for driving the timing element in one direction when the clutch is engaged and returning the timing element to a starting point when the clutch is disengaged, a control device, an operator for the control device having a timing position and a timed-out position, an electromagnet, means independent of the electromagnet continuously biasing said operator towards its timed-out position, drive means between the electromagnet and operator whereby motion of the electromagnet in one direction causes movement of the operator against its bias to timing position, means including a latch independent of the electromagnet for holding the operator in timing position, means for causing movement of the electromagnet in the opposite direction and starting said timing element, and means actuated by the timing element for releasing the latch to cause return of the operator to timed-out position.

19. The combination recited in claim 18 in which the drive means between the electromagnet and operator includes a latch which when released disables the drive means, and means actuated by the timing element for releasing both latches substantially simultaneously.

* * * * *